United States Patent [19]

Limper et al.

[11] 4,426,599

[45] Jan. 17, 1984

[54] TELEVISION CAMERA TUBE

[75] Inventors: Nicolaas H. Limper; Cornelis J. W. M. Scheffers, both of Eindhoven, Netherlands

[73] Assignee: U.S. Philips Corporation, New York, N.Y.

[21] Appl. No.: 284,437

[22] Filed: Jul. 20, 1981

[30] Foreign Application Priority Data

Aug. 22, 1980 [NL] Netherlands ..... 8004748

[51] Int. Cl.[3] ..... H01J 31/26

[52] U.S. Cl. ..... 313/389; 313/371; 313/453

[58] Field of Search ..... 313/389, 371, 453; 315/31 R

[56] References Cited

U.S. PATENT DOCUMENTS

| | | | |
|---|---|---|---|
| 3,928,784 | 12/1975 | Weijland | 313/389 |
| 4,268,777 | 5/1981 | van Roosmalen | 313/389 X |
| 4,382,213 | 5/1983 | Kajimura et al. | 313/389 X |

OTHER PUBLICATIONS

"The 'Plumbicon', A New Television Camera Tube", E. F. de Haan et al., Philips Tech. Rev., vol. 25, No. 6/7, pp. 133.180 (1963/1964).

"An experimental light-weight colour television camera", P. H. Broesse et al., Philips Tech. Rev., vol. 29, No. 11, pp. 325-335 (1968).

*Primary Examiner*—Eugene R. LaRoche

*Assistant Examiner*—Vincent De Luca

*Attorney, Agent, or Firm*—Marc D. Schecter

[57] ABSTRACT

A television camera tube comprising, in an evacuated envelope, an electron gun to generate an electron beam which during operation of the tube is focused to form a spot on a photosensitive target. On the target, a potential distribution is formed by projecting an optical image on it. By scanning the target with an electron beam, signals corresponding to the optical image are produced. The target is scanned in a line deflection direction and a frame deflection direction. According to the invention, the spot has an elongate shape, which shape is determined by a line at the edge of the spot which interconnects points having the same current density. The shape of the electron spot is such that the ratio, k, between the lengths of the long and short axes of the spot is $1.4 \leqq k \leqq 2$. The long axis of the spot divides the acute angle between the line deflection direction and the frame deflection direction in such manner that $$0° \leqq \beta \leqq 60°,$$

where $\beta$ is the angle between the long axis and the frame deflection direction. A television camera tube is obtained in which the modulation depth is (a) larger than in comparable tubes having a circular spot, (b) less dependent on the orientation of the usual test pattern for the modulation depth, and (c) substantially symmetrical with rotation of the test pattern from the vertical position.

8 Claims, 6 Drawing Figures

TELEVISION CAMERA TUBE

BACKGROUND OF THE INVENTION

The invention relates to a television camera tube comprising, in an evacuated envelope, an electron gun for generating an electron beam. During operation of the tube, the electron beam, is focused to form a spot on a photosensitive target. On the target, a potential distribution is formed by projecting an optical image on it. By scanning the target with an electron beam, signals corresponding to the said optical image are produced. The scanning takes place in a line deflection direction and a frame deflection direction.

The photosensitive target usually consists of a photoconductive layer which is provided on a signal plate. The potential distribution, sometimes called a potential image, is formed because the photoconductive layer may be considered to be composed of a large number of picture elements. Each picture element in turn may be considered as a capacitor to which a current source is connected in parallel the current strength of which is substantially proportional to the light intensity on the picture element. Hence the charge on each capacitor decreases linearly with time at constant light intensity.

As a result of the scanning, the electron beam passes through each element periodically and again charges the capacitor, which means that the voltage across each picture element is periodically brought to the potential of the cathode. The quantity of charge which is necessary periodically to charge one capacitor is proportional to the light intensity on the relevant picture element. The associated charge current flows via a signal resistance to the signal plate which all picture elements have in common. As a result of this, a voltage variation arises across the signal resistor, which voltage as a function of time represents the light intensity of the optical image as a function of the target location.

A television camera tube of the type is called a vidicon. A vidicon type television camera tube is known from the publication "Een experimentele kleine kleurentelevisiecamera" (An experimental small color television camera) in *Philips Technisch Tijdschrift,* Volume 29, 1968, No. 11.

In television camera tubes of the vidicon type the current density distribution in the electron beam is rotationally symmetrical at least up to a certain distance from the axis of the tube. The spot formed by the electron beam on the target may be considered as an electron-optical display of the smallest cross-section of the beam from the electron gun. The smallest cross-section of the beam occurs at either a cross-over, or a small circular bore sometimes called a diaphragm.

The display of this smallest beam cross-section is produced by rotationally symmetrical electrostatic and/or magnetic fields so that the current density distribution in the spot on the target is also rotationally symmetrical. A disadvantage of this rotationally symmetrical distribution in the spot is that upon scanning an optical image having a periodic pattern the modulation depth depends considerably on the orientation of the pattern relative to the line and frame deflection directions.

The modulation depth is a measure of the resolving power of the television camera tube and is defined as the ratio between the largest and the smallest value of the amplitude of the signal current upon scanning a given test pattern. The test pattern generally consists of vertical (perpendicular to the line deflection direction) light bands separated by equally wide dark bands. In some parts of the target the width of the band is such that approximately 20 pairs of light and dark bands could fill a complete picture height. In television technology this is called 40 "lines". In the remaining parts of the display screen this number is 200 pairs (that is 400 "lines"). The system of bands is scanned in the line deflection direction. When scanned by the electron beam, this text pattern provides a signal current which is an alternating current with respective fundamental frequencies of 0.5 and 5 MHz. These frequency values apply to a system of 625 lines per frame and a frame period of 1/25 second. For systems having a smaller or a larger number of lines and/or different frame periods, corresponding test patterns are possible.

The modulation depth is the value expressed in percent of the ratio of the amplitude of the 5 MHz signal and the 0.5 MHz signal. This measuring method is described in detail in the publication "Het plumbicon, een nieuwe televisie-opneembuis" (The plumbicon, a new television camera tube), Volume 25, 1963, No. 9). Upon rotation of such a test pattern with unvaried width of the bands relative to the deflection direction, the modulation depth as a function of the angle $\alpha$ ($\alpha$ being the angle between the direction of the bands of the test pattern and the frame deflection direction) proves to have an asymmetrical variation in whih a rotation of the test pattern to the right viewed from the camera tube will be considered as positive and a rotation to the left will be considered as negative. It is also assumed that the scanning takes place from the left to the right and from the top to the bottom of the frame. With negative angles $\alpha$, a rather strong decrease of the depth of modulation occurs relative to the usual position of the test pattern (which we define as $\alpha=0°$), With positive angles $\alpha$, the modulation depth initially increases and then decreases slowly only at large values of $\alpha$. It will be obvious that this nonsymmetrical strong dependence of the modulation depth on the orientation of the test pattern is not desired.

SUMMARY OF THE INVENTION

It is an object of the invention to provide a television camera tube in which the modulation depth is larger and is less dependent on the orientation of the test pattern.

It is a further object of the invention to provide a television camera tube in which the modulation depth is substantially symmetric as a function of $\alpha$ around $\alpha=0$.

According to the invention a television camera tube of the vidicon type is characterized in that the electron spot on the target has an elongate shape. The elongate shape is determined by a line at the edge of the spot which interconnects points having the same current density. The shape of the electron spot is such that the ratio, k, between the lengths of the long and short axes of the spot is $1.4 \leqq k \leqq 2$. The long axis of the spot divides the acute angle between the line deflection direction and the frame deflection direction in such manner that $$0° \leqq \beta \leqq 60°,$$

where $\beta$ is the angle between the long axis and the frame deflection direction.

It has been established that by making the current density distribution in the electron beam not rotationally symmetrical so that an elongate spot is formed, the long axis of which is approximately 1.4 to 2 times as long as the short axis and the long axis of which subtends an angle $\beta$ with the frame deflection direction, a substantially symmetrical variation of the modulation depth as a function of the angle $\alpha$ can be obtained without loss of definition in the vertical direction. The maximum value of the modulation depth then lies at approximately $\alpha=0°$ with a comparatively small decline of the modulation depth values for both positive and negative values of $\alpha$. The optimum orientation of the long axis of the spot is slightly dependent on the current density distribution within the spot and lies in the range $$0° \leqq \beta \leqq 60°$$

The ratio of the long and short axes of the spot preferably lies in the range $$1.4 \leqq k \leqq 2.$$

The spot may be rectangular in shape and have rounded corners. The axes of the rectangle are then determined by the length and width of the rectangle. For a spot which is substantially elliptical in shape, the long and the short axes are formed by the long and short axes of the ellipse.

Means to produce the nonrotationally symmetrical current density distribution in a spot are known per se. When rotationally symmetrical fields are used for the electron optical display, for example, an elliptical or rectangular diaphragm may be used in the television camera tube. It is also possible to obtain the elongate spot by means of a quadrupole lens in the electron optical system. In the case of magnetic focusing, in choosing the orientation of the diaphragm there should of course be taken into account the picture rotation caused by the magnetic field. Another possibility is a display system having different values of magnification in two mutually perpendicular directions, for example, while using quadrupole fields.

DESCRIPTION OF THE PREFERRED EMBODIMENTS

Figure 1:
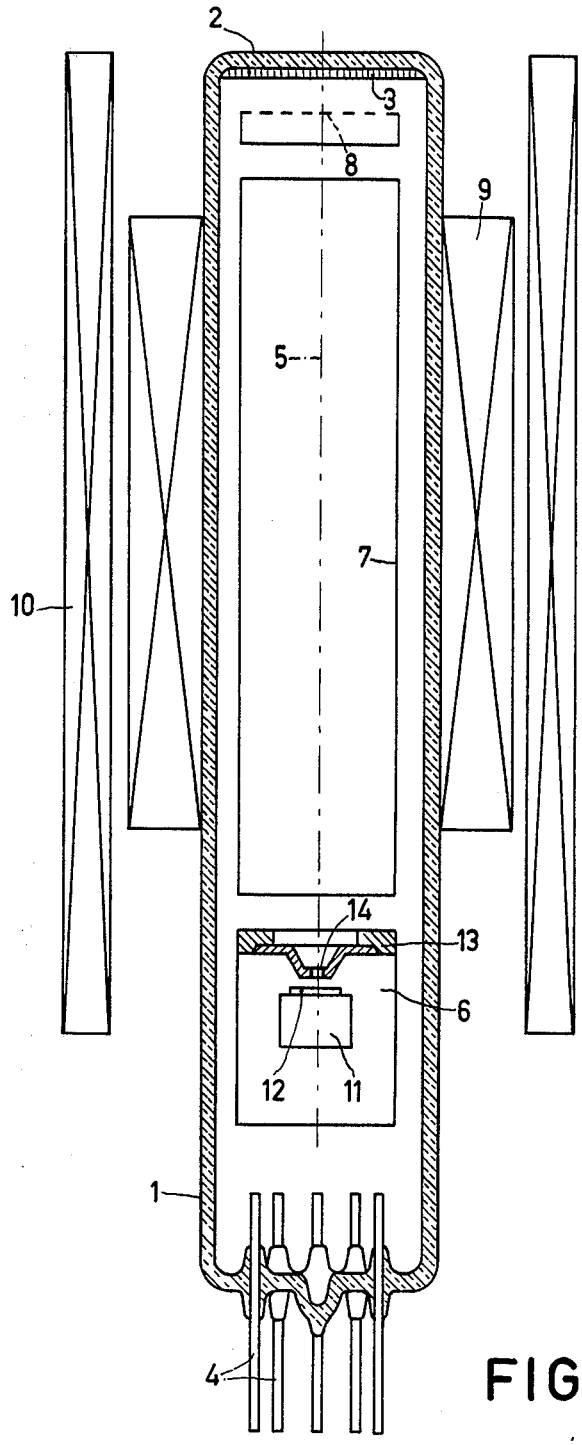
FIG. 1 is a partly schematic, partly cross-sectional view of a television camera tube according to the invention.

The camera tube shown in FIG. 1 is of the "Plumbicon" (trademark) type. It comprises a glass envelope 1 having on one side a window 2. The photosensitive target 3 is provided on the inside of window 2. The target 3 comprises a photoconductive layer and a transparent conductive signal plate between the photoconductive layer and the window. The photoconductive layer consists mainly of specially activated lead monoxide, and the signal plate consists of conductive tin oxide.

The connection pins 4 of the tube are present on the other side of the glass envelope 1. Centered along an axis 5, the camera tube comprises an electron gun 6 and a collector 7. The tube comprises in addition a gauze-like electrode 8 so as to produce a perpendicular landing of the electron beam on the target 3. The deflection coils 9 serve to deflect the electron beam generated by the electron gun 6 in two mutually perpendicular directions and to cause it to scan a frame on the target 3. The focusing coil 10 focuses the electron beam on the target 3.

The electron gun 6 comprises a cathode 11 having an emissive surface 12 and an anode 13. The connection of these components and their connections to the connection pins 4 are not shown in the Figure to reduce the complexity of the drawing. The anode 13 comprises such a small aperture 14 that it also forms a diaphragm. The aperture 14 is elliptical in shape and is placed at such an angle that the long axis of the elongate spot on the target 3 subtends an angle $\beta$ with the frame scanning direction.

Figure 2:
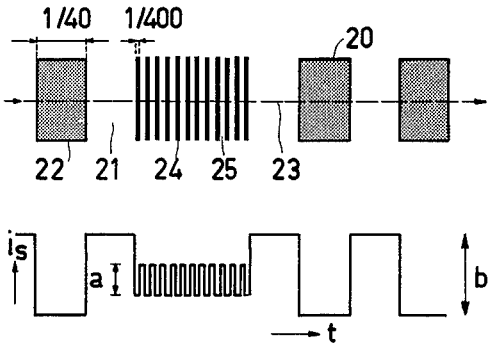
FIG. 2 is a schematic diagram of a test pattern and a signal produced by scanning the test pattern, which serves to explain the concept of modulation depth (MD).

The concept of modulation depth (MD) will now be described in greater detail with reference to FIG. 2. The test pattern 20 shown in the top of FIG. 2 is projected onto the target of the tube, the modulation depth of which is to be measured. This pattern comprises vertical light bands 21 separated by equally wide dark bands 22. In some parts of the pattern the width of the bands 20 is such that approximately 20 pairs of light and dark bands could fill a complete picture—in television technology this is called 40 "lines" in other parts of the pattern, 200 pairs corresponding to 400 "lines" would fill a complete picture.

When the electron spot passes through the corresponding charge image in the direction of broken line 23, the signal current from the tube has the shape as shown at the bottom of FIG. 2. At the area of the wide bands 21 and 22 a signal current having a fundamental frequency of 0.5 MHz is generated. At the area of narrower bands 24 and 25 a signal current having a fundamental frequency of 5 MHz is generated. These values apply to a system of 625 lines per frame and a frame period of 1/25 second. At the area of the wide dark bands 22 the signal current corresponds substantially to the dark current but at the area of the narrow bands the signal current is stronger. In the wide light bands the signal current is as strong as if the target were illuminated uniformly, but in the narrow bands the signal current is weaker. The difference in the signal current values $i_s$ for light and dark in the narrow bands is termed a and that in the wide bands is termed b. As a measure of the resolving power, the value expressed in percent of the ratio a/b is used this is the so-called modulation depth. Upon rotation of such a test pattern, with unvaried width of the bands, relative to the direction of deflection, the modulation depth proves to have an asymmetrical variation as a function of the angle of rotation. $\alpha$ is the angle between the direction of the band of the rotated test pattern and a line perpendicular to the line deflection direction. A rotation of the test pattern to the right viewed from the camera tube provides a positive $\alpha$ and rotation to the left provides a negative $\alpha$.

Figure 3:
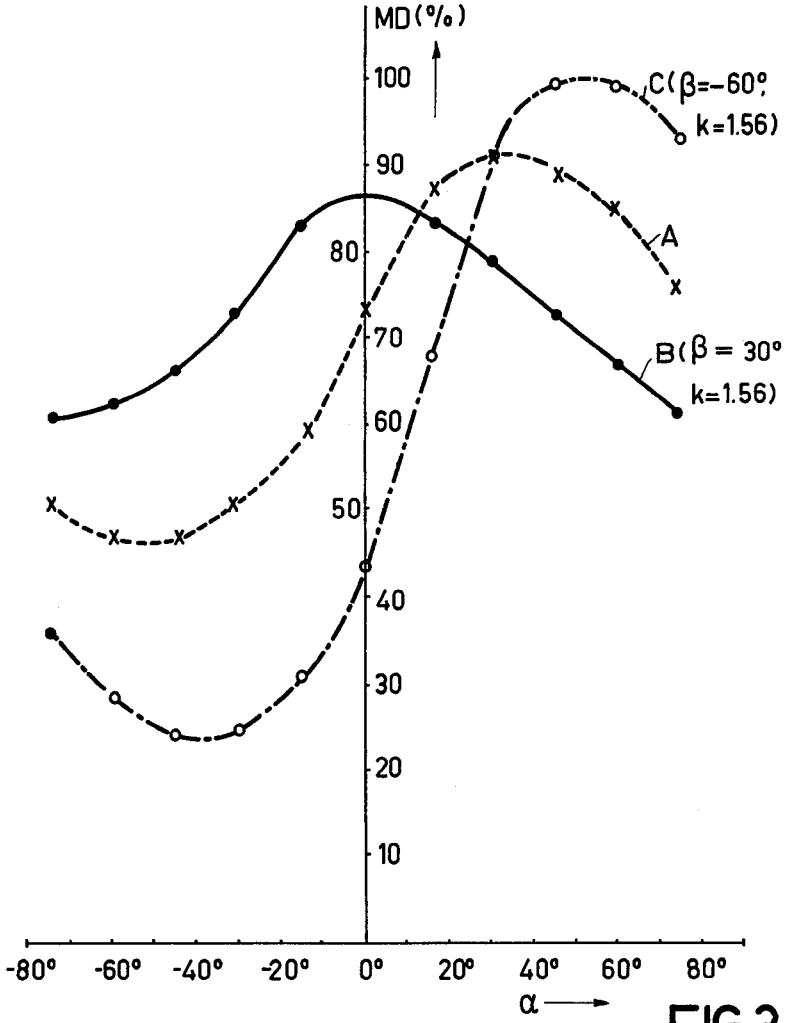
FIGS. 3 to 6 are graphs showing the variation of the modulation depth as a function of $\alpha$ for a number of values of $\beta$ and k.

FIG. 3 shows the modulation depth as a function of the angle $\alpha$ both for a rotationally symmetrical spot and for an elliptical spot. For the elliptical spot the modulation depth is shown for a number of values of $\beta$ and k. Curve A gives an example of the variation of the modulation depth as a function of $\alpha$ for a rotationally symmetrical spot. The modulation depth in this case is 74% for $\alpha=0°$. For positive and negative $\alpha$ the variation is strongly non-symmetrical. Such a sensitivity of the modulation depth to the direction of the camera tube is not desired. Curve B shows the variation of the modulation depth as a function of $\alpha$ for an elliptical spot having $k=1.56$ and $\beta=30°$. The modulation depth is 86% for $\alpha=0$ and is substantially symmetrical for positive and negative $\alpha$.

Curve C shows the variation of the modulation depth as a function of $\alpha$ for the same spot but now with $\beta=-60°$. This direction falling outside the scope of the invention give a modulation depth of approximately 44% at $\alpha=0$ and a very strong nonsymmetrical variation for positive and negative $\alpha$.

Figure 4:
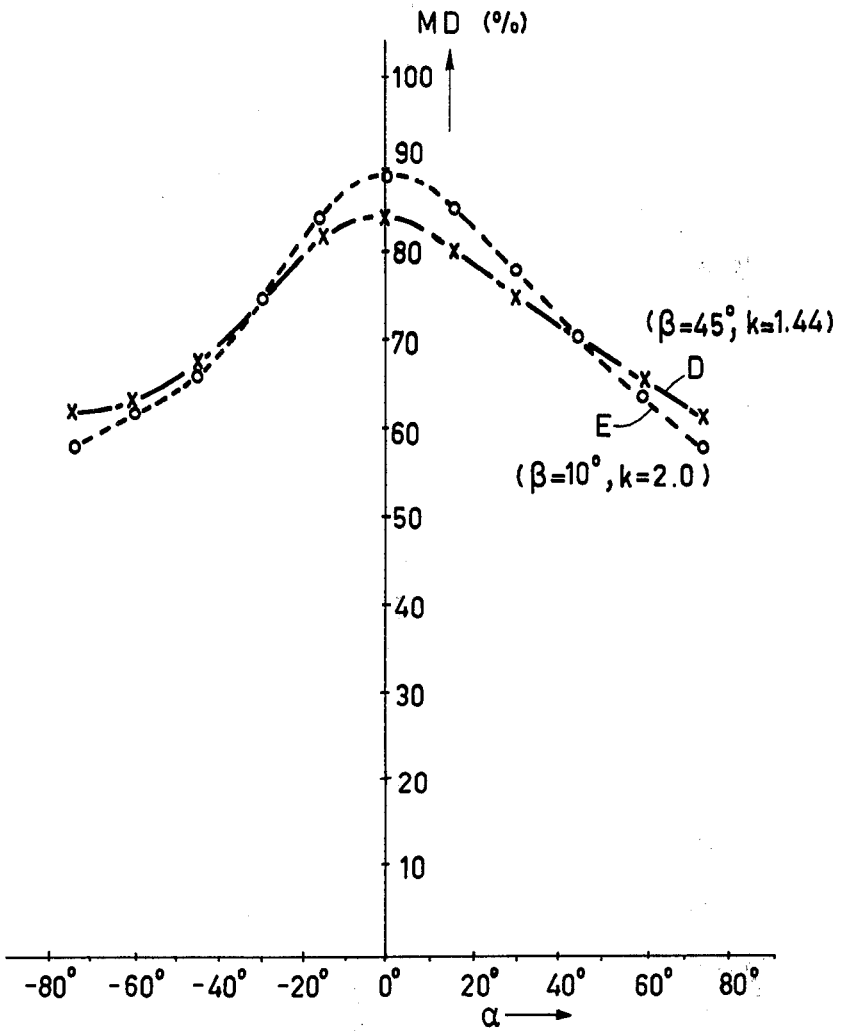

FIG. 4 shows the variation of the modulation depth as a function of $\alpha$ for two elliptical spots. Curve D with $\beta=45°$ and $k=1.44$ and E with $\beta=10°$ and $k=2.0$. Consideration of the curves D, E and B (FIG. 3) teaches that (a) the angle $\beta$ at which the modulation depth has a symmetrical variation decreases with increasing k, and (b) the difference between the largest and the smallest value of the modulation depth (MD) becomes larger with increasing k.

Figure 5:
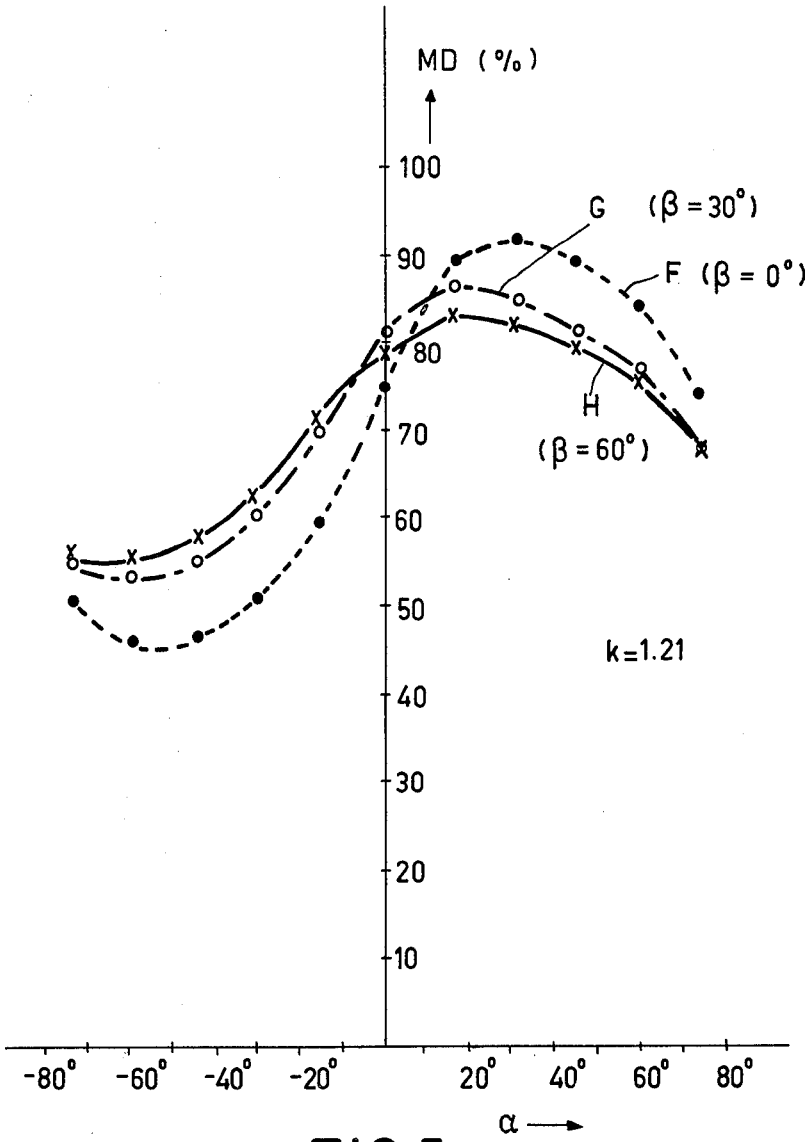

FIG. 5 shows the variation of the modulation depth as a function of $\alpha$ for a spot with $k=1.21$ for three values of $\beta$(0°, 30° and 60°). The desired effect, a substantially symmetrical variation of the modulation depth, is not achieved with this value of k. The angle $\beta$ proves to be of hardly any influence. The modulation depth as a function of $\alpha$ varies substantially as with a rotationally symmetrical spot. The desired effect starts occurring at $k \geqq 1.4$ (see, for example, FIG. 4, curve D).

Figure 6:
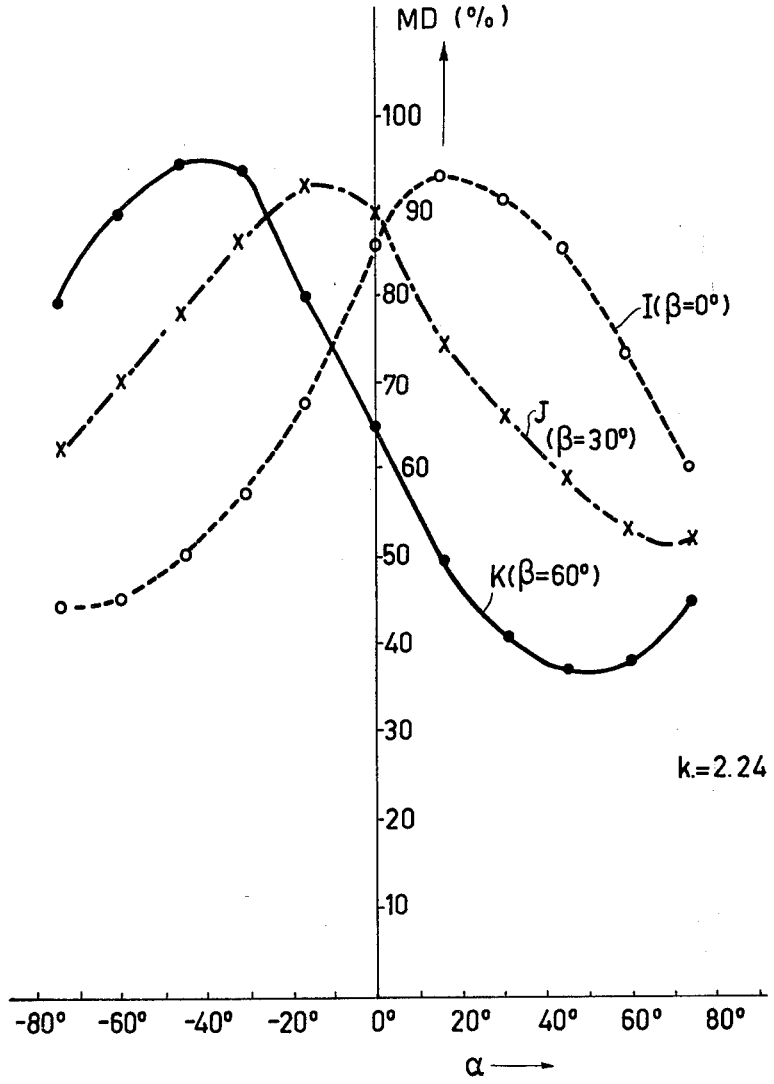

FIG. 6 shows the variation of the modulation depth as a function of $\alpha$ for a spot with $k=2.24$ for three values of $\beta$(0°, 30° and 60°). The variation of the modulation depth is still reasonably symmetrical only somewhere between $\beta=0°$ and $\beta=30°$ at this value of k. So the spot is nearly perpendicular to the line scanning direction. With such a long spot, the vertical resolving power (in the frame deflection direction) is adversely influenced.

The upper limit of k ($k \leqq 2$) is the result of the consideration that (a) at $K>2$ no improvement of the modulation depth and the symmetry of the variation occurs any longer, but (b) a deterioration of the vertical resolving power does occur.

What is claimed is:

1. A television camera tube comprising:

an evacuated envelope;

a photosensitive target in the envelope;

an electron gun for generating an electron beam;

means for focusing the electron beam to a spot on the target, the electron spot having a shape which is defined by a line at the edge of the spot which connects points having the same current density;

means for scanning the electron spot across the target in a line deflection direction and in a frame deflection direction;

means for shaping the electron spot into an elongate shape, wherein the ratio, k, between the lengths of the long and short axes of the spot is $1.4 \leqq k \leqq 2$, and where the long axis of the spot divides the acute angle between the line deflection direction and the frame deflection direction in such manner that the angle, $\beta$, between the long axis and the frame deflection direction is $0 \leqq \beta \leqq 60°$.

2. A television camera tube as claimed in claim 1, characterized in that the means for shaping the electron spot comprises a diaphragm having an elliptical opening arranged in the path of the electron beam.

3. A television camera tube as claimed in claim 1, characterized in that the means for shaping the electron spot comprises a diaphragm having a rectangular opening arranged in the path of the electron beam.

4. A television camera tube as claimed in claim 1, characterized in that the means for shaping the electron spot comprises means for generating a quadrupole electron lens in the path of the electron beam.

5. A method of scanning a photosensitive target in an evacuated envelope of a television camera tube, said method comprising the steps of:

generating an electron beam;

focusing the electron beam to a spot on the target, the electron spot having a shape which is defined by a line at the edge of the spot which connects points having the same current density;

scanning the electron spot across the target in a line deflection direction and in a frame deflection direction;

shaping the electron spot into an elongate shape, where the ratio, k, between the lengths of the long and short axes of the spot is $1.4 \leqq k \leqq 2$, and where the long axis of the spot divides the acute angle between the line deflection direction and the frame deflection direction in such manner that the angle, $\beta$, between the long axis and the frame deflection direction is $0 \leqq \beta \leqq 60°$.

6. A method as claimed in claim 5, characterized in that the step of shaping the electron spot comprises passing the electron beam through a diaphragm having an elliptical opening therein.

7. A method as claimed in claim 5, characterized in that the step of shaping the electron spot comprises passing the electron beam through a diaphragm having a rectangular opening therein.

8. A method as claimed in claim 5, characterized in that the step of shaping the electron spot comprises passing the electron beam through a quadrupole electron lens.

* * * * *